US007472655B2

(12) United States Patent
Leng

(10) Patent No.: US 7,472,655 B2
(45) Date of Patent: Jan. 6, 2009

(54) TABLE TOP

(76) Inventor: Lu Hao Leng, Room 312, No. 170, Danue Road, Siming District, Xiamen City, Fujian Province (CN) 361003

( * ) Notice: Subject to any disclaimer, the term of this patent is extended or adjusted under 35 U.S.C. 154(b) by 368 days.

(21) Appl. No.: 10/824,215

(22) Filed: Apr. 14, 2004

(65) Prior Publication Data

US 2005/0081760 A1 Apr. 21, 2005

(30) Foreign Application Priority Data

Jul. 1, 2003 (CN) ..... 03 2 68739
Jul. 28, 2003 (CN) ..... 03 2 69260

(51) Int. Cl.
*A47B 17/00* (2006.01)

(52) U.S. Cl. ..... 108/27; 108/59; 108/153.1; 108/161

(58) Field of Classification Search ..... 108/27, 108/161, 59, 153.1, 157.14
See application file for complete search history.

(56) References Cited

U.S. PATENT DOCUMENTS 2,654,649 A * 10/1953 Pasewalk et al. ..... 108/159
2,717,187 A * 9/1955 Morgan et al. ..... 108/27
2,876,053 A * 3/1959 Eves ..... 108/27
3,676,279 A * 7/1972 Beaver ..... 108/161
5,623,882 A * 4/1997 Price ..... 108/161
5,868,081 A * 2/1999 Raab ..... 108/161
5,947,037 A * 9/1999 Hornberger et al. ..... 108/27
6,058,854 A * 5/2000 Tarnay et al. ..... 108/161
6,837,171 B1 * 1/2005 Clark et al. ..... 108/161
7,059,255 B2 * 6/2006 Tsai ..... 108/161

* cited by examiner

*Primary Examiner*—Jose V. Chen
(74) *Attorney, Agent, or Firm*—Barnes & Thornburg LLP

(57) ABSTRACT

A table top includes an exterior shell providing an interior region. An interior frame and a core are located in the interior region. The exterior shell includes top and bottom sheets and a perimeter bumper.

36 Claims, 9 Drawing Sheets

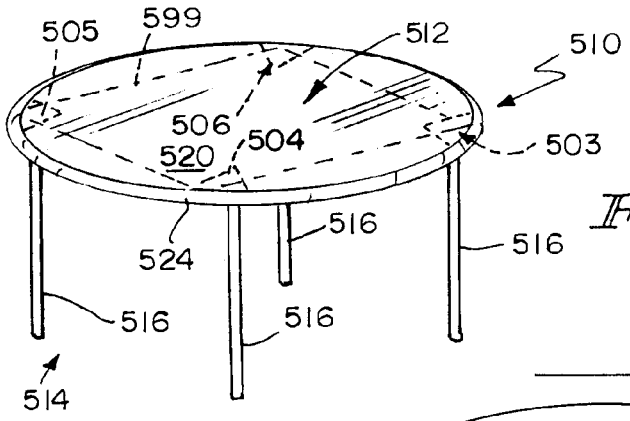
FIG. 16
FIG. 17
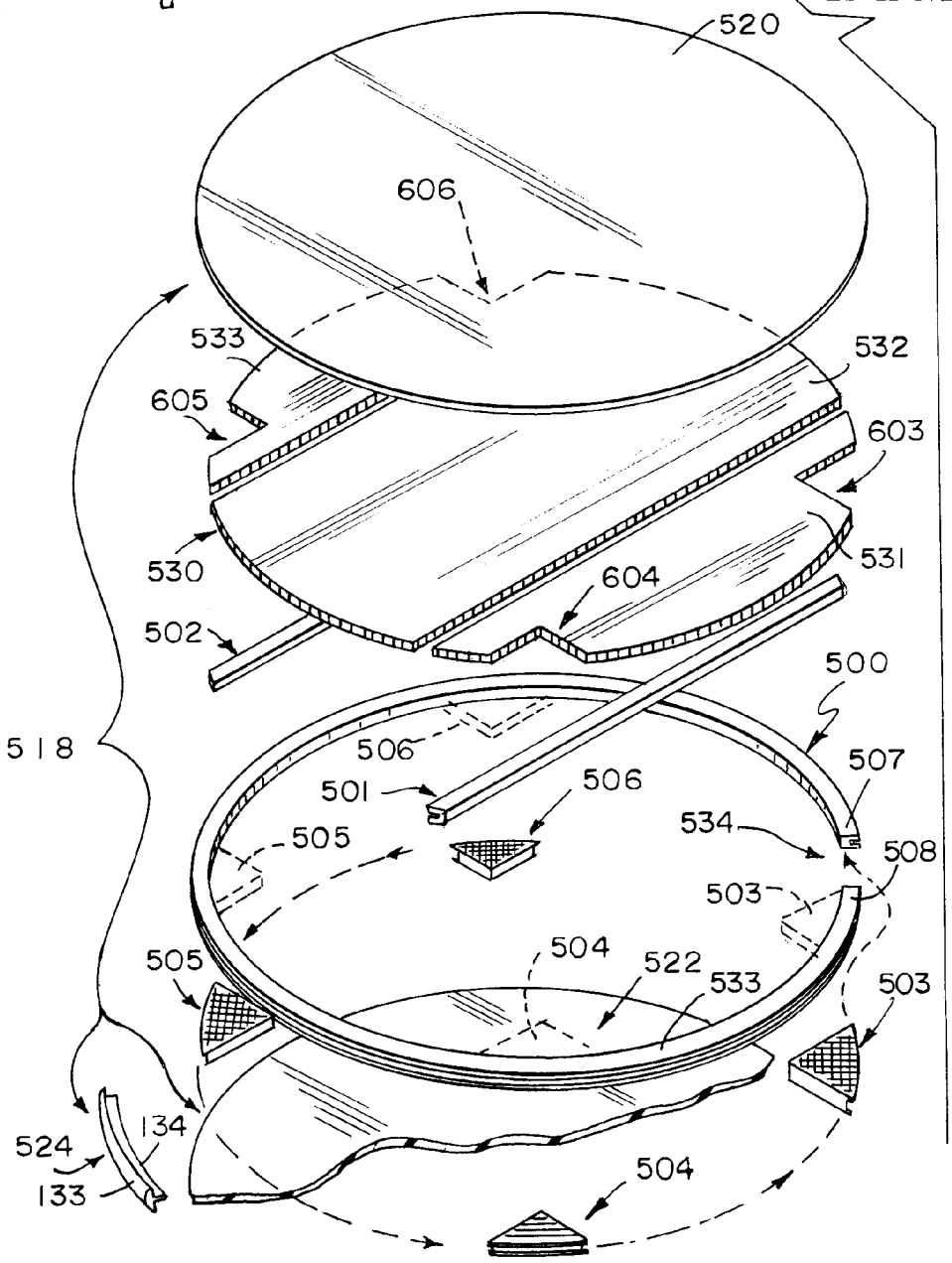

TABLE TOP

This application claims priority under 35 U.S.C. § 119(a)-(d) to Chinese Patent Application No. 03269260.9, filed Jul. 28, 2003 and Chinese Patent Application No. 03268739.7, filed Jul. 1, 2003, which are expressly incorporated by reference herein.

BACKGROUND

The present disclosure relates to a table and, in particular, to a table top. More particularly, the present disclosure relates to multi-component table tops.

SUMMARY

A table top includes an exterior shell, an interior frame in an interior region defined by the exterior shell, and a core surrounded by the interior frame. The interior frame includes one or more rails and blocks coupled to the rails and located between the rails and the core.

In one illustrative embodiment of the disclosure, four rails are slidably connected to four corner blocks to provide a rectangular interior frame surrounding a cellular core, and two side blocks are also slidably connected to the rails. During assembly of the components to produce this table top, the two side blocks are slid on two of the rails to reach a selected position, and all of the rails are then slid into mating positions with the four corner blocks to establish the interior frame.

The cellular core is then placed in an interior space defined by the interior frame and the exterior shell is coupled to the interior frame to produce the table top. A table leg frame is arranged to underlie the exterior shell and is anchored using suitable fasteners to the corner and side blocks located in the interior region of the exterior shell.

In another illustrative embodiment of the disclosure, four side blocks are slidably connected to a circular rail to provide an interior frame surrounding a cellular core. During assembly of the components to produce this table top, a curved rail with two opposed ends is provided and in series four side blocks are slid onto the curved rail at one of these ends and moved along a curved path established by the curved rail to assume predetermined circumferentially spaced-apart positions. The two opposed ends are then coupled to produce an "endless" circular rail carrying four spaced-apart side blocks.

The cellular core is then placed in an interior space defined by the interior frame and the exterior shell is coupled to the interior frame to produce the table top. A table leg frame is arranged to underlie the exterior shell and is anchored using suitable fasteners to the four side blocks located in the interior region of the exterior shell.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 16 is a perspective view of a table including a table top in accordance with a second embodiment of the disclosure;

FIG. 17 is an exploded perspective view of the table top of FIG. 16 showing, from top to bottom, a top sheet, a cellular core, an interior frame comprising a curved rail, two rigidifying beams, two small side blocks, and two larger side blocks that can be assembled to surround the core, a portion of a bottom sheet, and a portion of a circular perimeter bumper that is configured to cooperate with the top and bottom sheets to form an exterior shell containing the cellular core and the interior frame;

DETAILED DESCRIPTION

Figure 1:
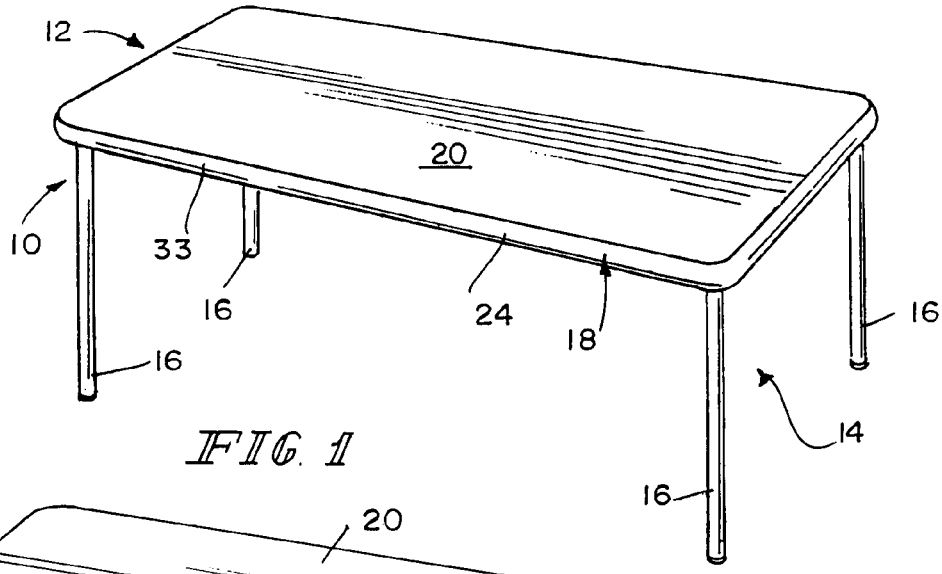
FIG. 1 is a perspective view of a table including a table top in accordance with a first embodiment of the disclosure.

A table 10 includes a table top 12 and a table leg frame 14 including four legs 16 and supporting table top 12 in an elevated position as suggested in FIG. 1. A rectangular table top 12 is illustrated in FIGS. 1-15 while a round table top 512 is illustrated in FIGS. 16-20.

Figure 2:
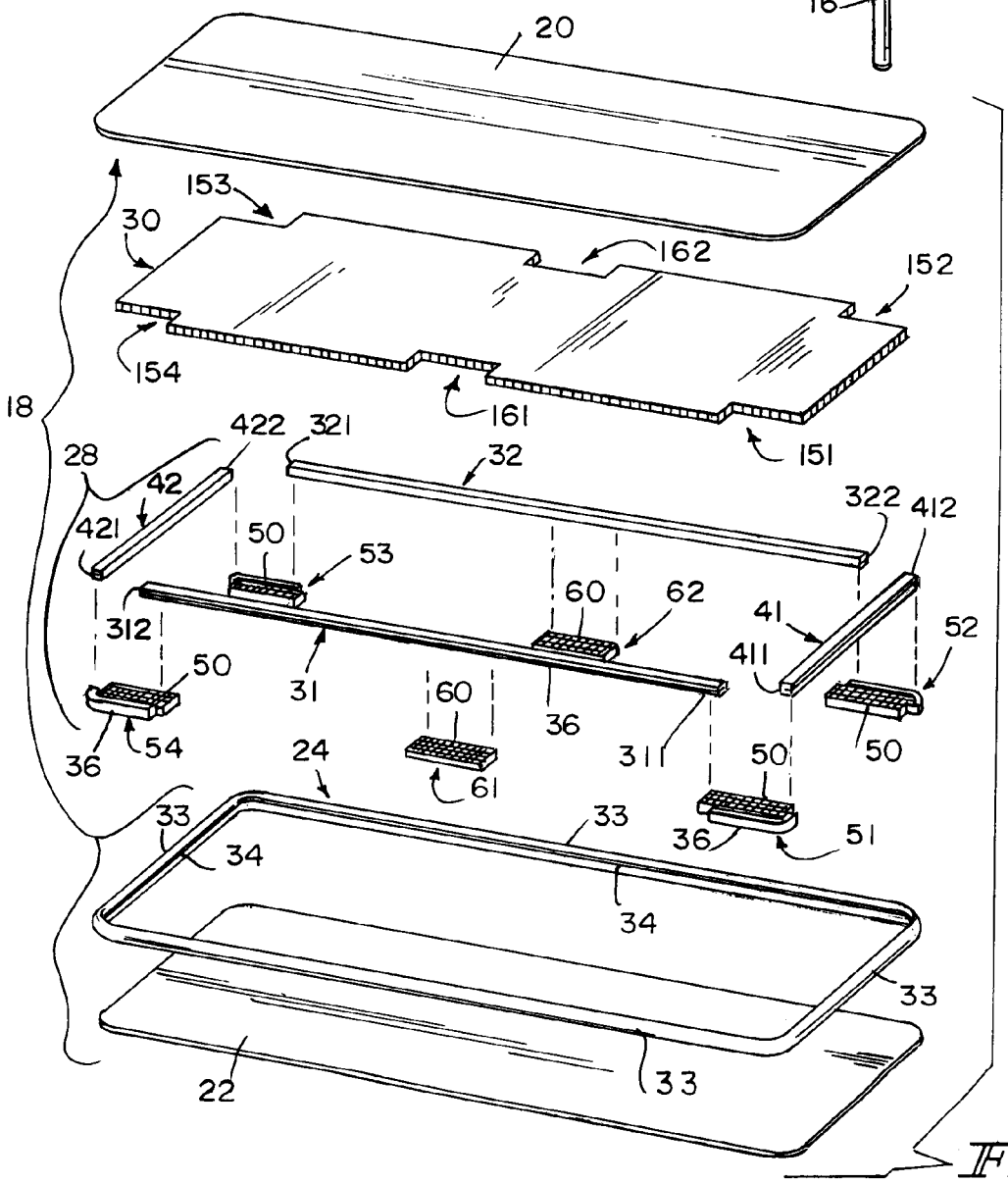
FIG. 2 is an exploded perspective view of the table top of FIG. 1 showing, from top to bottom, a top sheet, a cellular core, an interior frame comprising four rails and six blocks that can be assembled to surround the core, a perimeter bumper configured to be mounted to an exterior portion of the interior frame, and a bottom sheet configured to cooperate with the top sheet and the perimeter bumper to form an exterior shell containing the cellular core and the interior frame.

As shown in FIG. 2, table top 12 includes an exterior shell 18 including a top sheet 20, a bottom sheet 22, and a perimeter bumper 24. These components cooperate to form an interior region 26 containing an interior frame 28 and a core 30 when assembled, for example, as shown in FIG. 3.

Interior frame 28 includes first and second side rails 31, 32, first and second end rails 41, 42, and six blocks configured to be coupled to the rails to rigidify table top 12 and provide sturdy foundations to which table leg frame 14 may be mounted. In an illustrative embodiment, the rails are extruded and the blocks are injection-molded. In the illustrated embodiment, these blocks include first, second, third, and fourth corner blocks 51, 52, 53, and 54 and first and second side blocks 61, 62. The corner blocks add strength in the corners of table top 12 to act as shock absorbers and enhance "drop resistance" and "side impact resistance" of table top 12. It is within the scope of this disclosure to vary the number, spacing, and location of such blocks to meet structural and drop or side impact resistance needs of any particular table top.

Figure 3:
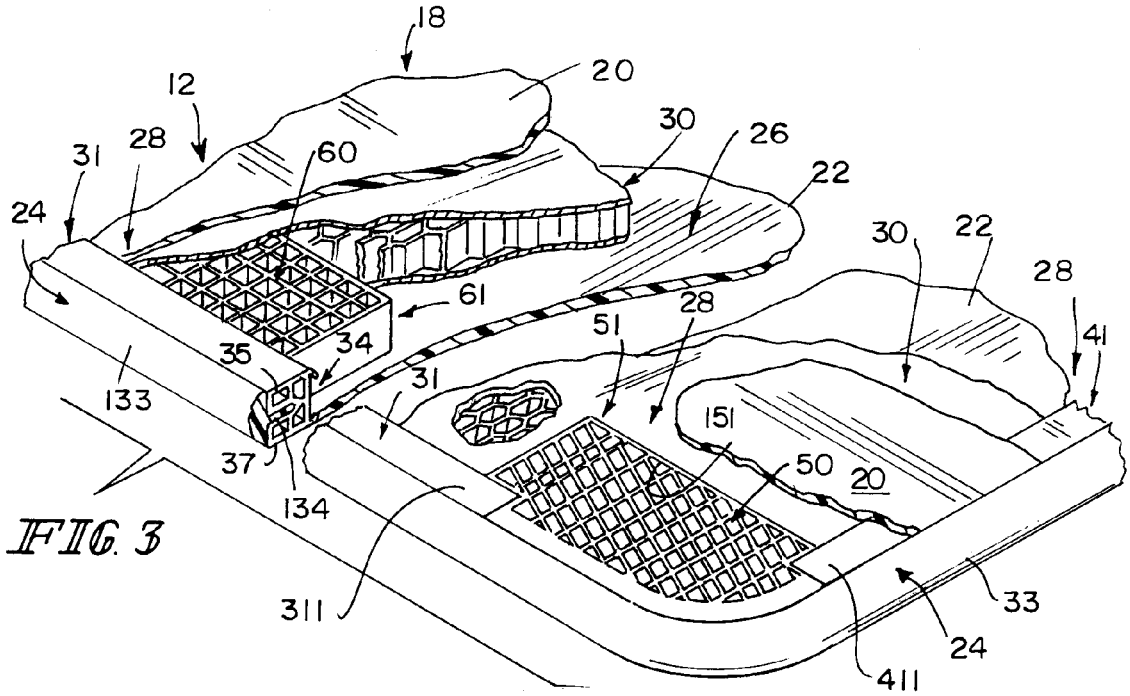
FIG. 3 is an enlarged perspective view of a portion of the table top of FIG. 1, with portions broken away, showing the cellular core located in an interior region defined by the exterior shell, a first side block coupled to a first side rail and a first corner block coupled to the first side rail and to a first end rail to form a portion of the interior frame around the cellular core, and coupling of a portion of the perimeter bumper to the first side and end rails and to the first corner block.

Core 30 illustratively has a cellular structure as suggested in FIG. 3 and is made, for example, of corrugated material. Core 30 is sized and shaped to lie in a space bounded by side rails 31, 32, end rails 41, 42, and blocks 51, 52, 53, 54, 61, and 62 and in interior region 26 formed in exterior shell 18. It is within the scope of this disclosure to form core 30 of any suitable material to add body to table top 12 in the region between top and bottom sheets 20, 22.

As shown in FIG. 2, core 30 is formed to include a first corner cutout 151 sized and located to receiver first corner block 51 therein, a second corner cutout 152 sized and located to receive second corner block 52 therein, a third corner cutout 153 sized and located to receive third corner block 53 therein, and a fourth corner cutout 154 sized and located to receive fourth corner block 54 therein. Core 30 is also formed to include a first side cutout 161 sized and located to receive first side block 61 therein and a second side cutout 162 sized and located to receive second side block 62 therein. When assembled as shown, core 30 substantially fills the space between top and bottom sheets 20, 22 and inside interior frame 28 defined by rails 31, 41, 32, and 42 and blocks 61, 51, 52, 62, 53, and 54.

Figure 5:
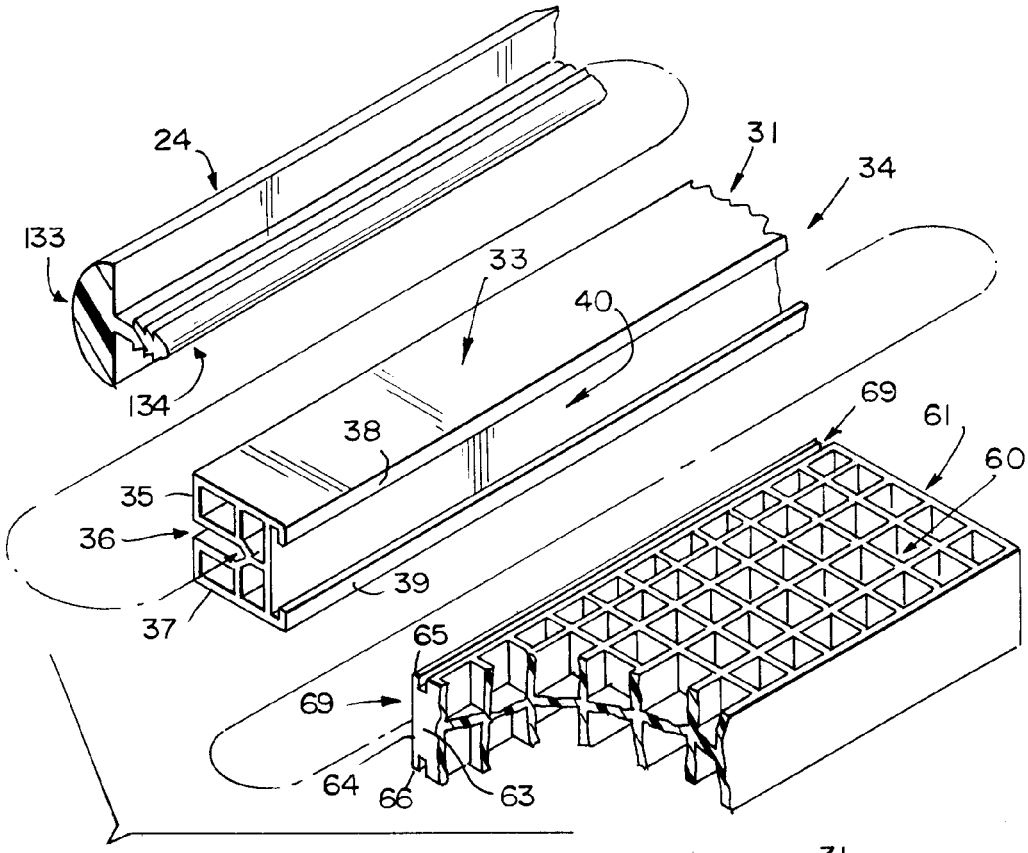
FIG. 5 is a view similar to FIG. 4 taken from another point of view.
Figure 6:
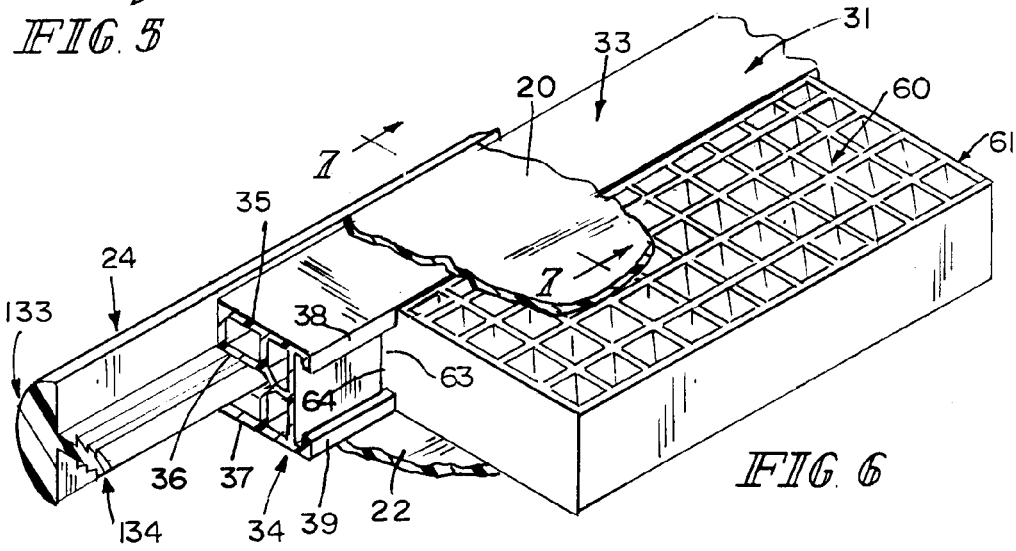
FIG. 6 is a perspective view of the components shown in FIG. 5 after assembly of the components and attachment of the top and bottom sheets to the interior frame.
Figure 7:
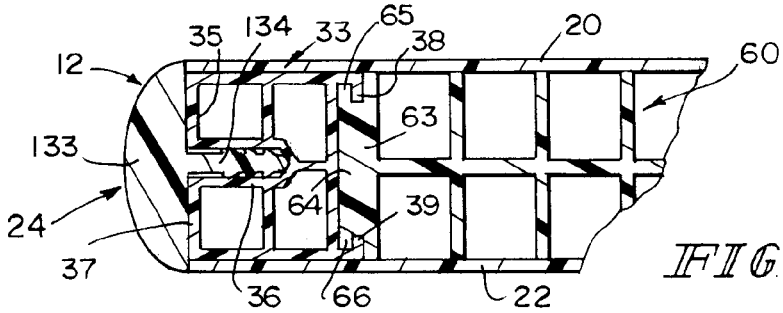
FIG. 7 is a sectional view taken along line 7-7 of FIG. 6.
Figure 8:
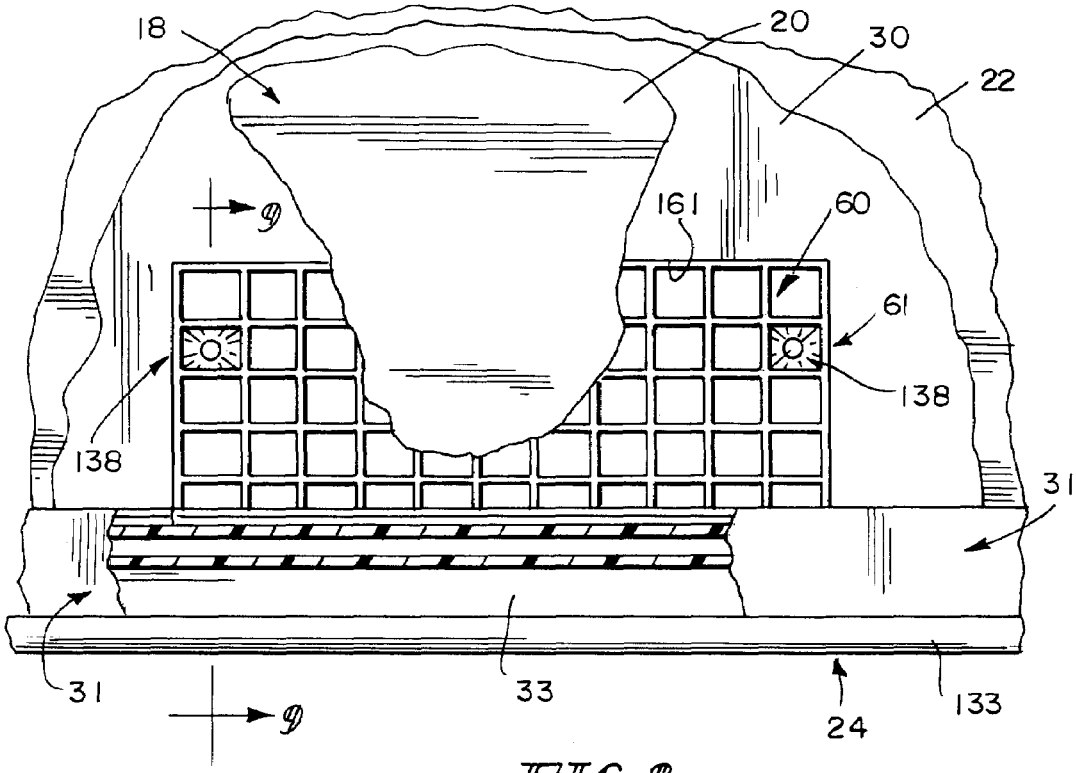
FIG. 8 is a top plan view of a portion of the table top of FIG. 1, with portions broken away, showing the first side block coupled to the first side rail.
Figure 9:
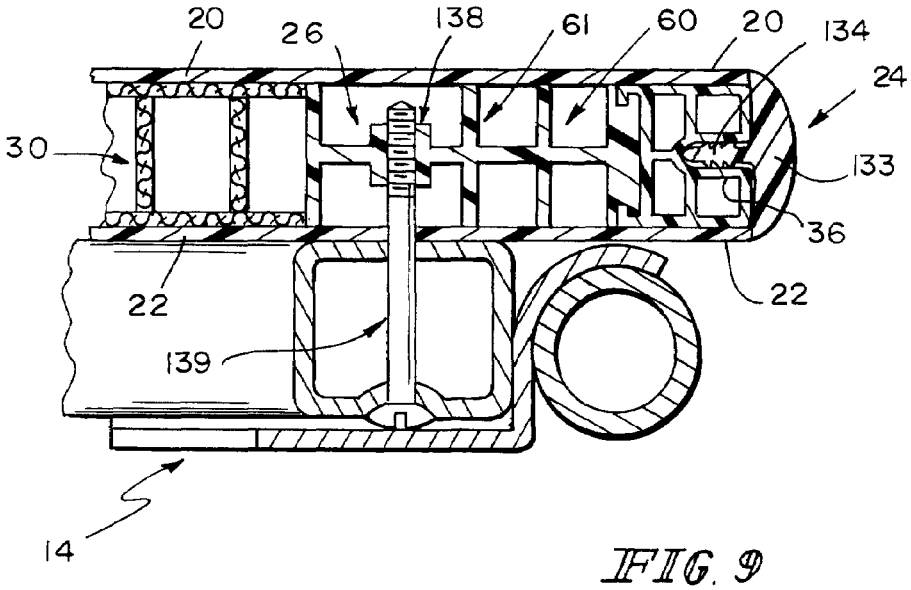
FIG. 9 is an enlarged sectional view taken along line 9-9 of FIG. 8 showing portions of an exterior table leg frame mounted on an underside of the table top of FIG. 8.
Figure 10:
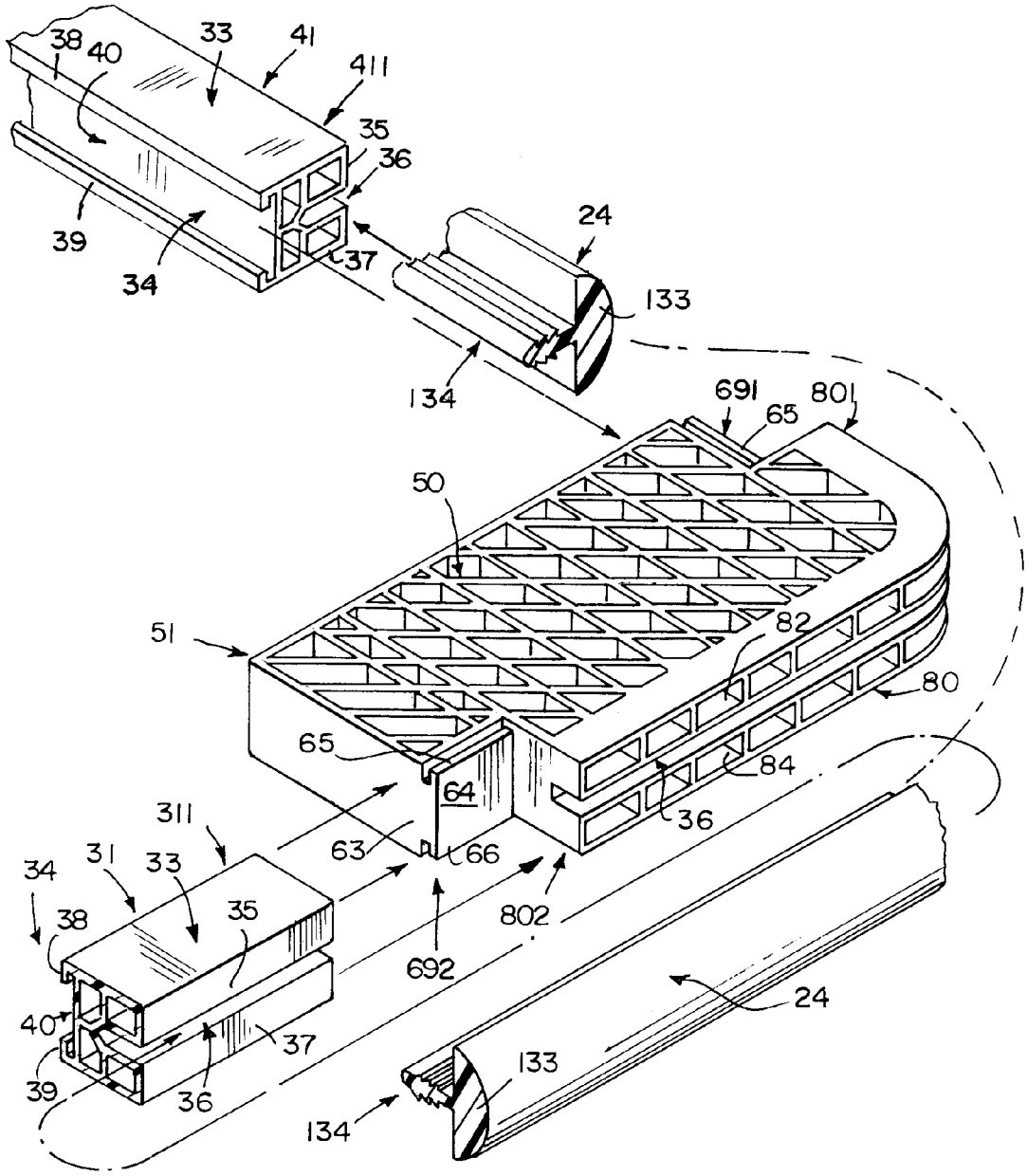
FIG. 10 is an enlarged perspective assembly view of portions of the perimeter bumper, first side and end rails, and first corner block of FIG. 3 suggesting how those components are coupled to one another.
Figures 11, 12:
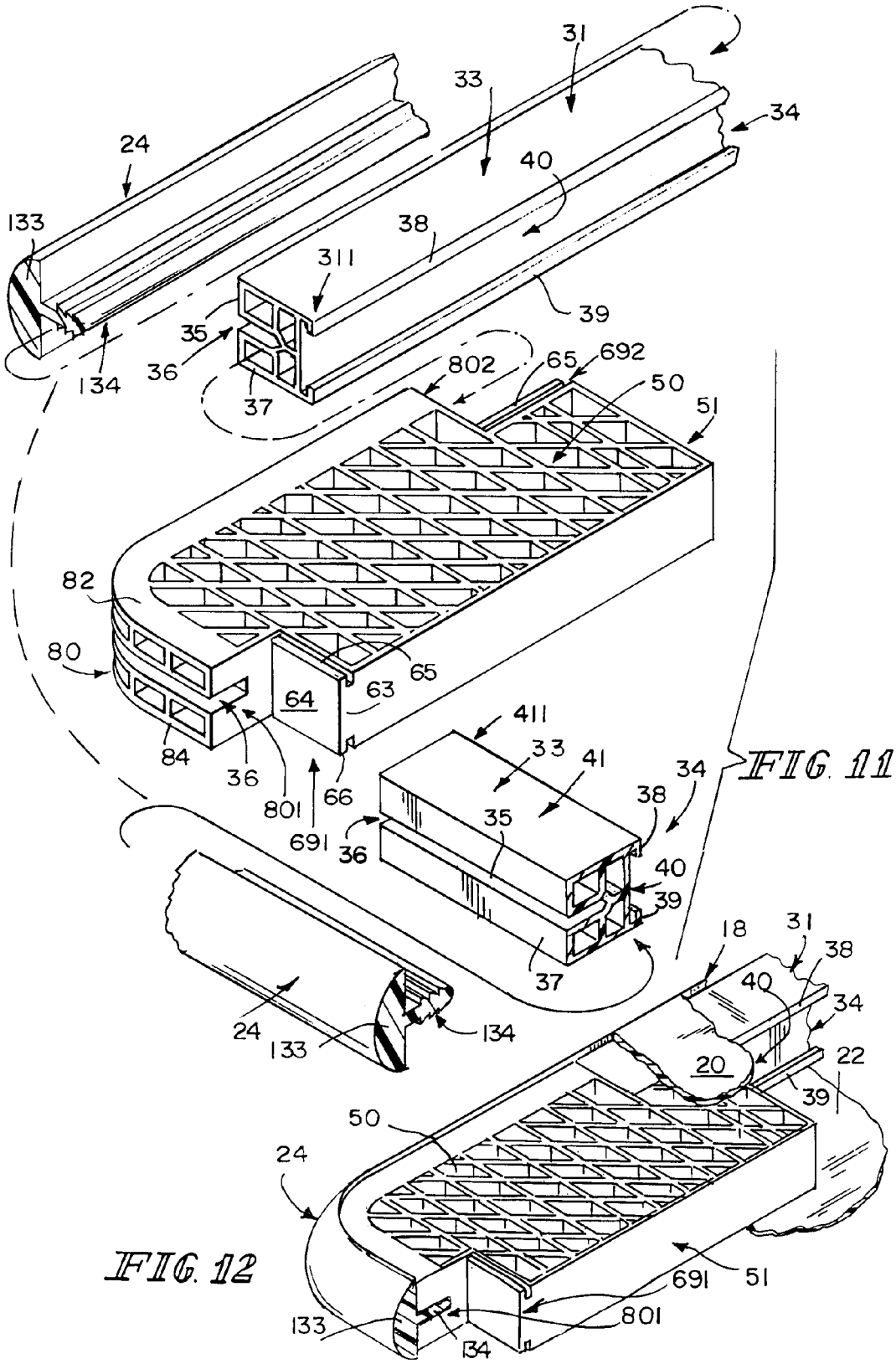
FIG. 11 is a view similar to FIG. 10 taken from another point of view.
FIG. 12 is a perspective view of some of the components shown in FIG. 11 after assembly of the components and attachment of the top and bottom sheets to the interior frame.
Figure 13:
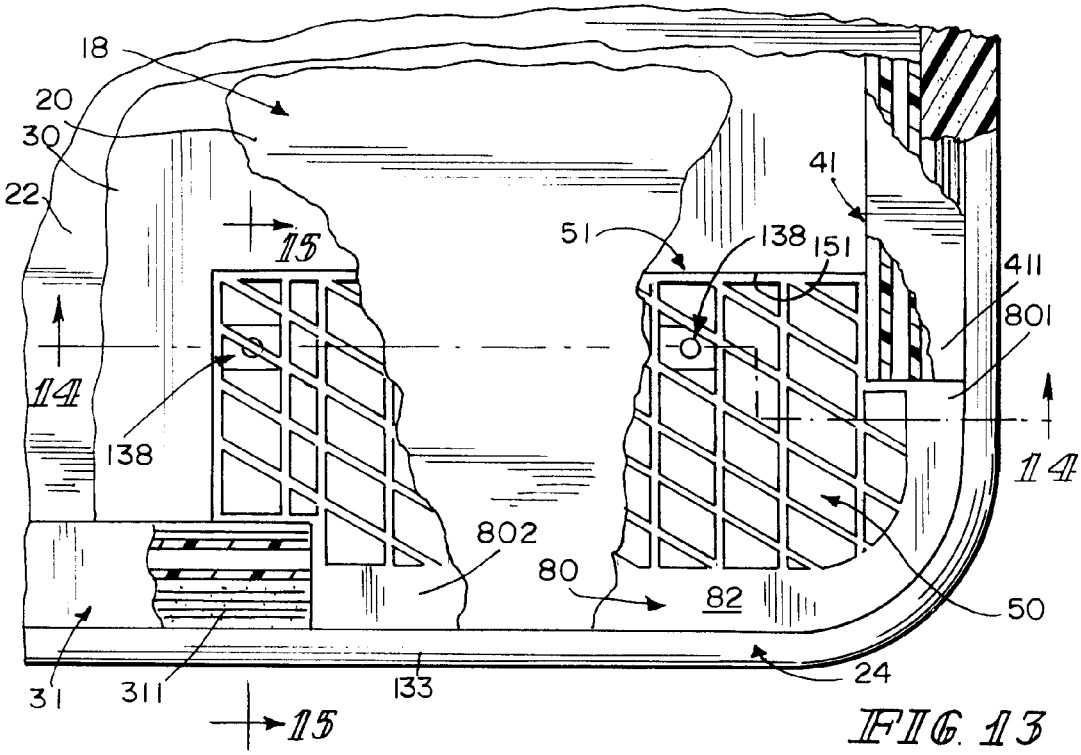
FIG. 13 is a top plan view of another portion of the table top of FIG. 1, with portions broken away, showing the first corner block coupled to the first side and end rails and to the perimeter bumper.
Figure 14:
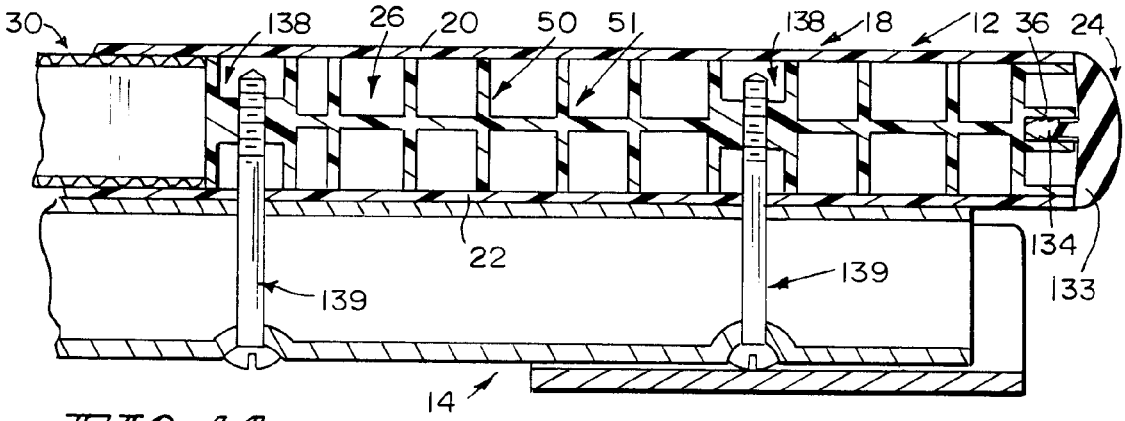
FIG. 14 is an enlarged sectional view taken along line 14-14 of FIG. 13 showing portions of an exterior frame coupled to the underside of the table top of FIG. 13.
Figure 15:
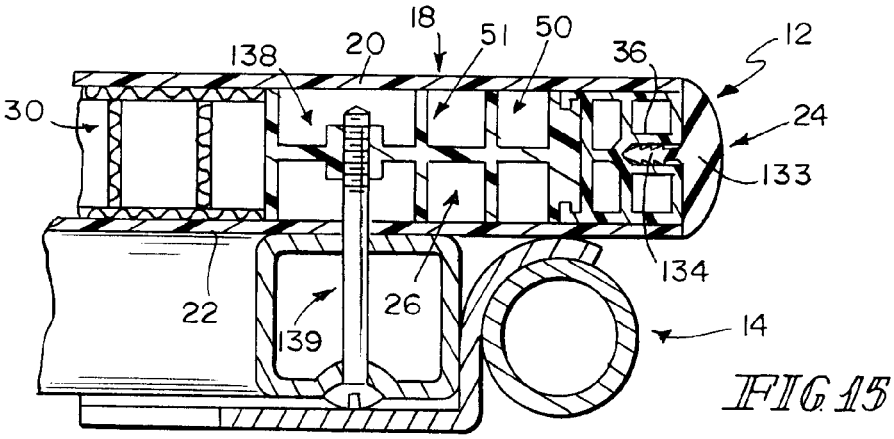
FIG. 15 is a sectional view taken along line 15-15 of FIG. 13.

As suggested in FIG. 2, when assembled, corner blocks 51, 52, 53, 54 are used to retain side rails 31, 32 in spaced-apart parallel relation to one another and end rails 41, 42 in spaced-apart parallel relation to one another to define a rectangular interior frame 28. First corner block 51 is coupled to a first end 311 of first side rail 31 and a first end 411 of first end rail 41. Second corner block 52 is coupled to a second end 412 of first end rail 41 and a second end 322 of second side rail 32. Third corner block 53 is coupled to a first end 321 of second side rail 32 and to a second end 422 of second end rail 42. Fourth corner block 54 is coupled to a first end 421 of second end rail 42 and a second end 312 of first side rail 31. Illustrative "slide-initiated" couplings for corner blocks and rails are shown in FIGS. 5, 10, and 11.

Figure 4:
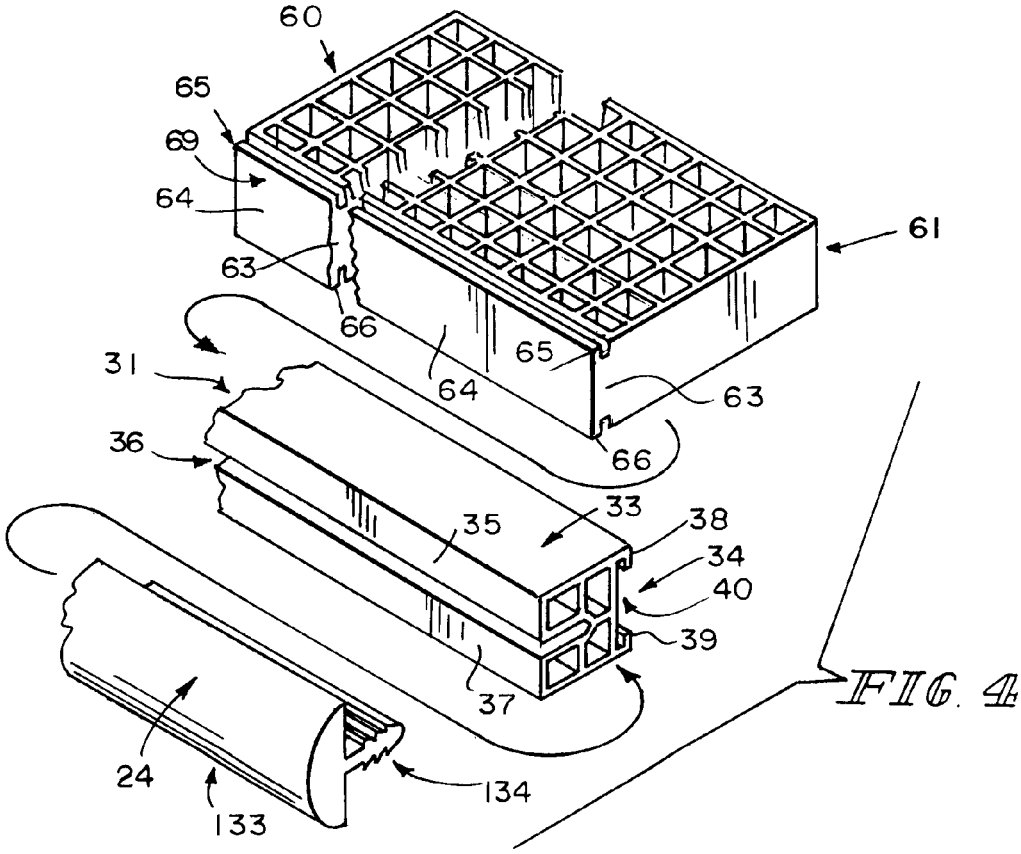
FIG. 4 is an enlarged perspective assembly view of portions of the perimeter bumper, first side rail, and first side block of FIG. 3 suggesting how these components are coupled to one another.

As also suggested in FIG. 2, when assembled, each side block 61, 62 will be coupled to one of side rails 31, 32 and arranged to lie about midway between first and second end rails 41, 42. Illustrative slide-initiated couplings for side blocks and rails are shown in FIGS. 4 and 5. Core 30 will then be placed into a space bounded, in part, by assembled rails 31, 41, 32, and 42 and blocks 61, 51, 52, 62, 53, and 54 so that those blocks fit into the spaces provided by cutouts 161, 151, 152, 162, 153, and 154 formed in core 30.

Exterior shell 18 can be assembled and mounted to surround interior frame 28 and core 30 in many different yet suitable ways. In the illustrated embodiment, top sheet 20 and bottom sheet 22 are made of an ABS thermoplastic material and are coupled using, for example, a suitable adhesive material to one or more of exposed surfaces of rails 31, 41, 32, 42, corner blocks 51, 52, 53, 54, and core 30. Also in the illustrated embodiment, perimeter bumper 24 is coupled to perimeter portions of rails 31, 41, 32, 42 and corner blocks 51, 52, 53, 54 using, for example, a bumper retainer 134 that projects away from outer rim 33 of perimeter bumper 24 and is sized and shaped to mate with exposed bumper receivers 36 formed in rails 31, 41, 32, 42 and corner blocks 51, 52, 53, 54. It is within the scope of this disclosure to use other suitable means for mounting perimeter bumper 24 on interior frame 28.

As suggested in FIGS. 8, 9, and 13-15, side blocks 61, 62 and corner blocks 51, 52, 53, 54 are configured to provide anchor foundations for anchoring table leg frame 14 in place on the underside of table top 12. Each block is formed to include one or more fastener receiver means 138 for receiving a fastener 139 included in table leg frame 14 to couple table leg frame 14 to bottom sheet 22 so that table leg frame 14 is anchored in a fixed position to bottom sheet 22 (or other suitable portion) of table top 12. In the illustrated embodiment, each fastener receiver means 138 is formed in a rigidifying member 50 included in each corner block 51, 52, 53, 54 or in a rigidifying member 60 included in each side block 61, 62.

First side rail 31 is coupled to first side block 61 and bumper retainer of perimeter bumper 24 as suggested in FIGS. 4-7. Second side rail 32 is coupled to second side block 62 and bumper retainer 134 of perimeter bumper 24 in a similar manner.

First side block 61 includes a rigidifying member 60 arranged to lie adjacent to core 30 as shown in FIG. 3 and an interlock portion 69 appended to rigidifying member 60 and coupled to first side rail 31 as suggested in FIGS. 4-7. In the illustrated embodiment, rigidifying member 60 comprises a honeycomb structure and interlock portion 69 is a T-shaped rail mount comprising a neck 63 cantilevered to rigidifying member 60 and a slide member 64 mounted on neck 63 to provide an elongated upwardly extending upper lip 65 and an elongated downwardly extending lower lip 66 as shown best in FIGS. 4 and 5. In the illustrated embodiment, first side block 61 is monolithic and made of a plastics material.

First side rail 31 includes a base 33 coupled to perimeter bumper 24 and formed to include bumper receiver 36. First side rail 31 also includes an interlock portion 34 appended to base 33 and formed to mate with interlock portion 69 included in first side block 61 as suggested in FIGS. 4 and 5 and shown in FIGS. 6 and 7. In the illustrated embodiment, first side rail 31 is monolithic and made of a plastics material.

Base 33 of first side rail 31 includes an upper strip 35 and a lower strip 37. Lower strip 37 is arranged to lie in spaced-apart parallel relation to upper strip 35 to provide therebetween an elongated channel (bumper receiver) 36 receiving a portion (e.g., bumper retainer 134) of perimeter bumper 24 therein to retain perimeter bumper 24 in a fixed position on first side rail 31 a shown, for example, in FIGS. 3, 6, and 7.

First side rail 31 further includes elongated upper and lower flanges 38, 39 coupled to base 33 to establish interlock portion 34. Upper and lower flanges 38, 39 are arranged to provide therebetween a rail mount receiver 40 extending along a length of first side rail 31 as shown best in FIG. 5. As suggested in FIGS. 4-7, the T-shaped rail mount (interlock portion) 69 of first side block 61 is arranged to extend into and slide back and forth in rail mount receiver 40 defined between upper and lower flanges 38, 39. Interlock portion 34 of first side rail 31 and interlock portion 69 of first side block 61 are coupled to one another and cooperate to define means for mounting rigidifying member 60 of first side block 61 for sliding movement relative to base 33 of first side rail 31 so that rigidifying member 60 can be moved to assume a selected position on base 33 during assembly of interior frame 28 and preparatory to insertion of core 30 in interior region 26 of exterior shell 18.

Each of the other rails 41, 32, and 42 has a structure that is the same as the structure of first side rail 31. Second side block 62 has the same configuration as first side block 61 and is coupled to second side rail 32 in the same manner as first side block 61 is coupled to first side rail 31. In the illustrated embodiment, each side block 61, 62 is slid on its companion side rail 31, 32 to reach a selected position during assembly of the components to produce table top 12.

Mating of a corner block to side and end rails is shown, for example, in FIGS. 10-12. Although it within the scope of this disclosure to couple distal ends of a side rail and an end rail to a corner block using any suitable coupling, in the illustrated embodiment, each corner block is formed to include a first corner interlock portion 691 for (slidably) mating with an interlock portion 34 included in a companion end rail (e.g., 41 or 42) and a second corner interlock portion 692 for (slidably) mating with an interlock portion 34 included in a companion side rail (e.g., 31 or 32).

As shown in FIGS. 10 and 11, first corner block 51 includes a first corner interlock portion 691 coupled to rigidifying member 50 and configured to mate with interlock portion 34 on first end 411 of first end rail 41. First corner block 51 also includes a second corner interlock portion 692 coupled to rigidifying member 50 and configured to mate with interlock portion 34 on first end 311 of first side rail 31. Each of these corner interlock portions 691, 692 includes a neck 63 and a slide member 64 coupled to neck 63 to provide upper lip 65 and lower lip 66 and configured to mate with interlock portion 34 and to slide back and forth in rail mount receiver 40.

First corner block 51 also includes a substantially L-shaped bumper mount 80 having one end 801 arranged to lie in confronting relation to first end 411 of first end rail 41 and in close proximity to first corner interlock portion 691 as shown in FIG. 11. Bumper mount 80 also has a second end 802 arranged to lie in confronting relation to first end 311 of first side rail 31 and in close proximity to second corner interlock portion 692 as shown in FIG. 10. L-shaped bumper mount 80 is coupled to rigidifying member 50 and to perimeter bumper 24 and arranged to project outwardly from rigidifying member 50 to lie in a space located between first ends 411, 311 of first end and side rails 41, 31 as shown, for example, in FIGS. 10 and 11.

Bumper mount 80 includes an upper strip 82 adapted to be coupled to top sheet 20 and a lower strip 84 adapted to be coupled to bottom sheet 22. Upper and lower strips 20, 22 are arranged to lie in spaced-apart relation to one another to provide therebetween an elongated channel defining bumper receiver 36 as shown in FIGS. 10 and 11.

During assembly of the components to produce table top 12, the two side blocks 61, 62 are slid on the two side rails 31, 32 to reach a selected position, for example, midway along the length of each side rail 31, 32. All of the side and end rails 31, 32, 41, 42 are then slid into mating positions with the companion interlock portions 691, 692 of the four corner blocks 53, 54, 55, 56 to form interior frame 28. Core 30 is then placed in an interior space defined by interior frame 28 and exterior shell 18 is coupled to interior frame 28 to produce table top 12. Table leg frame 14 is then arranged to underlie exterior shell 18 and is anchored using fasteners 139 to fastener receivers 138 formed in side and corner blocks 61, 62, 53, 54, 55, 56 located in interior region 26 of exterior shell 18.

Figure 18:
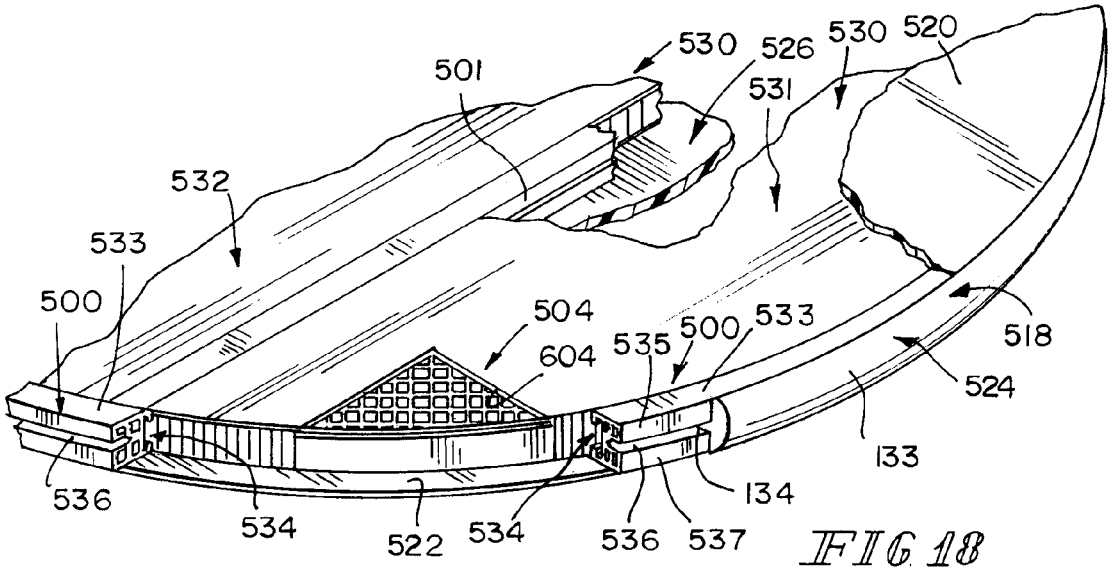
FIG. 18 is an enlarged perspective view of a portion of the table top of FIG. 1, with portions broken away, showing a rigidifying beam and the cellular core located in an interior region defined by the exterior shell, a first side block coupled to the circular rail, and coupling of a portion of the perimeter bumper to the circular rail.
Figure 19:
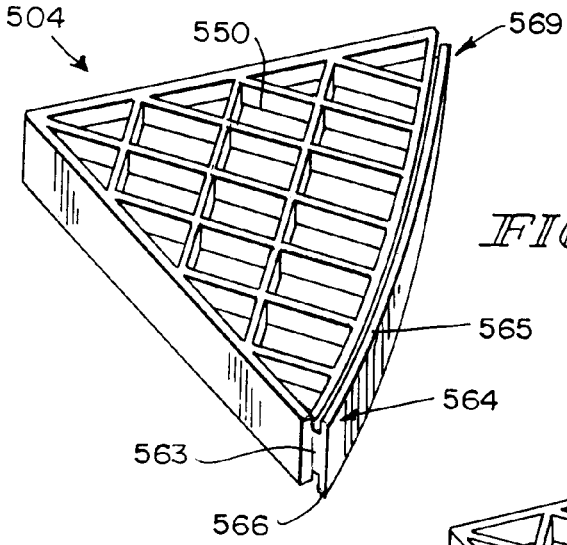
FIG. 19 is an enlarged perspective view of a small side block.
Figure 20:
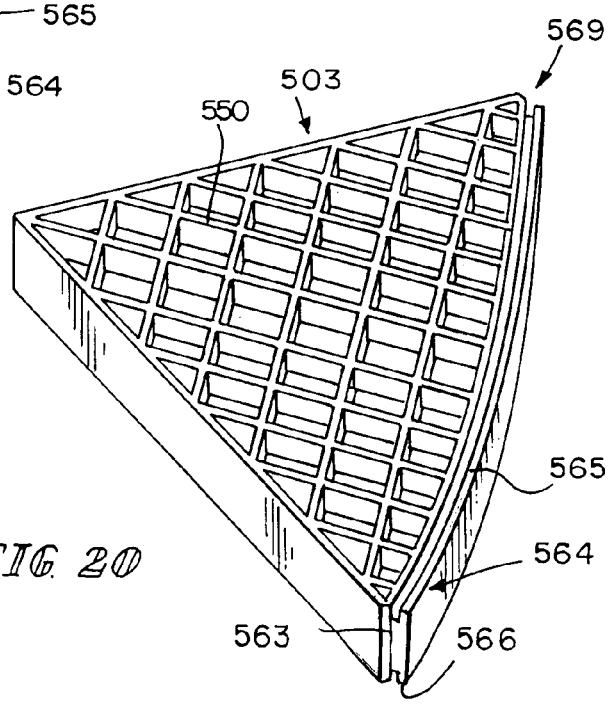
FIG. 20 is an enlarged perspective view of a larger side block.

A round table 510 in accordance with a second embodiment of the disclosure is illustrated in FIG. 16 and includes a table top 512 and a table leg frame 514. As shown in FIGS. 16 and 17, a round table top 512 includes an exterior shell 518 including a top sheet 520, a bottom sheet 522, and a perimeter bumper 524. These components cooperate to form an interior region 526 containing an interior frame 528 and a core 530 when assembled, for example, as shown in FIG. 18. In the illustrated embodiment, interior frame 528 includes circular rail 500, first and second rigidifying beams 501, 502, and four side blocks 503, 504, 505, 506 coupled to circular rail 500.

Interior frame 528 includes circular rail 500 and in series first, second, third, and fourth side blocks 503, 504, 505, 506 slidably coupled to circular rail 500 for sliding movement along and around a circular path established by circular rail 500 to assume a selected position on circular rail 500 as suggested in FIG. 17. Once assembled, side blocks 503, 504, 505, 506 are arranged to lie in circumferentially spaced-apart relation about circular rail 500 as suggested in FIG. 16. Once the blocks are coupled to circular rail 500, first and second ends 507, 508 of circular rail 500 can be coupled to one another to form an endless loop. In the illustrated embodiment, blocks 504 and 506 have a first size and blocks 503 and 505 have a larger second size. The size difference is a function of the configuration of the size and shape of the table leg frame 514 underlying table top 512.

Once assembled, first, second, third, and fourth side blocks 503, 504, 505, 506 are arranged to lie in spaced-apart relation to one another about circular rail 500 to form "corners" of a "reference rectangle" 599 inscribed in circular rail 500 as suggested in FIG. 16. Like side blocks 61, 62 shown in FIGS. 8 and 9, each side block 503, 504, 505, 506 includes fastener receiver means (not shown) for receiving a fastener (not shown but similar to fastener 139 in FIG. 9) arranged to couple table leg frame 514 to bottom sheet 522 so that table leg frame 514 is anchored in a fixed position on bottom sheet 522 of table top 512.

Interior frame 528 further includes a first rigidifying beam 501 having a first end coupled to circular rail 500 and an opposite second end coupled to circular rail. Interior frame 528 also includes a second rigidifying beam 502 having a first end coupled to circular rail 500 and an opposite second end coupled to circular rail 500. Although each beam 501, 502 illustratively has the same cross-section as side rail 61, it is within the scope of this disclosure to vary that cross-section to create a beam of suitable rigidity. Beams 501 and 502 are arranged to lie in spaced-apart parallel relation to one another as suggested in FIG. 17.

As suggested in FIG. 17, core 530 includes a first core portion 531 lying on one side of first rigidifying beam 501, a second core portion 532 lying on an opposite side of first rigidifying beam 501 and between beams 501 and 502, and a third core portion 503 lying between a portion of circular rail 500 and beam 502. Second core portion 502 lies on one side of second rigidifying beam 502 and third core portion 503 lies on an opposite side of second rigidifying beam 502.

As shown in FIG. 17, first core portion 531 is formed to include a first side cutout 603 sized and located to receive first side block 503 therein and a second side cutout 604 sized and located to receive second side block 504 therein. Third core portion 533 is formed to include a third side cutout 605 sized and located to receive third side block 505 therein and a fourth side cutout 606 sized and located to receive fourth side block 506 therein.

Circular rail 500 includes a base 533 coupled to perimeter bumper 524 and a curved interlock portion 534 appended to base 533. First side block 503 includes a rigidifying member 550 arranged to lie adjacent to cellular core 30 and a curved interlock portion 569 appended to rigidifying member 550. Curved interlock portions 534, 569 of circular rail 500 and first side block 503 are coupled to one another and cooperate to define interlock means for mounting rigidifying member 550 for sliding movement along a curved path relative to base 533 so that rigidifying member 550 can be moved to assume a selected position on base 533 of circular rail 500 during assembly of interior frame 528 and preparatory to insertion of cellular core 530 in interior region 526 of exterior shell 518.

Base 533 of circular rail 500 includes a curved upper strip 535 and a curved lower strip 537 arranged to lie in spaced-apart relation to curved upper strip 535 to provide therebetween an elongated curved channel 536 receiving a portion 134 of the perimeter bumper 524 therein to retain perimeter bumper 524 in a fixed position on circular rail 500.

Circular rail 500 also includes curved upper and lower flanges 538, 539 arranged to provide therebetween a curved rail mount receiver 540 extending along a curved length of circular rail 500. First side block 504 includes a pie-shaped rigidifying member 550 arranged to lie adjacent to cellular core 530 and a curved rail mount (interlock portion) 569 appended to rigidifying member 550 and arranged to extend into the curved rail mount receiver 540 defined between curved upper and lower flanges 538, 539. Curved rail mount 569 includes a curved T-shaped rail mount comprising a curved neck 563 cantilevered to rigidifying member 550 and a curved slide member 564 mounted on curved neck 563 to provide an elongated upwardly extending curved upper lip 565 and an elongated downwardly extending curved lower lip 566 as shown best in FIG. 20.

During assembly of the components to produce table top 512, a curved rail 500 with two opposed ends 507, 508 is provided and in series four side blocks 503, 504, 505, 506 are slid onto curved rail 500 at one of those ends 507, 508 and moved along a curved path established by the curved rail to assume circumferentially spaced-apart positions as suggested in FIG. 17. The two opposed ends 507, 508 are then coupled to produce an "endless" circular rail carrying four spaced-apart side blocks. Perimeter bumper 524 is coupled to circular rail 500. Top and bottom sheets 520, 522 are coupled to one or more of circular rail 500, beams 501, 502, and core 530 to retain core 530 in interior region 526 of exterior shell 518. Table leg frame 514 is then arranged to underlie exterior shell 518 and is anchored using suitable fasteners (not shown) to fastener receivers (not shown) formed in side blocks 503, 504, 505, 506 located in interior region 526 of exterior shell 18.

The invention claimed is:

1. A table top comprising an exterior shell including a top sheet, a bottom sheet underlying the top sheet to define an interior region therebetween, and a perimeter bumper extending around the top and bottom sheets to define another boundary of the interior region, a cellular core located in the interior region and arranged to lie between the top and bottom sheets, and an interior frame located in the interior region, the interior frame including a rail interposed between the perimeter bumper and the cellular core and coupled to the perimeter bumper and at least one block interposed between the rail and the cellular core and coupled to the rail to rigidify the exterior shell wherein the at least one block includes a first side block and a corner block, the first side block coupled to the first side rail and arranged to lie in spaced-apart relation to the corner block, the corner block coupled to adjacent ends of a side rail and an end rail.

2. The table top of claim 1, wherein the rail includes first and second side rails arranged to lie in spaced-apart relation to one another to locate the cellular core therebetween and first and second end rails arranged to lie in spaced-apart relation to one another to locate the cellular core therebetween, the at least one block includes four corner blocks, a first of the corner blocks is coupled to adjacent ends of the first side rail and first end rail, a second of the corner blocks is coupled to adjacent ends of the first end rail and second side rail, a third of the corner blocks is coupled to adjacent ends of the second side rail and second end rail, and a fourth of the corner blocks is coupled to adjacent ends of the second end rail and first side rail.

3. The table top of claim 2, wherein the cellular core is formed to include a first corner cutout located to receive the first of the corner blocks therein, a second corner cutout located to receive the second of the corner blocks therein, a third corner cutout located to receive a third of the corner blocks therein, and a fourth corner cutout located to receive a fourth of the corner blocks therein.

4. The table top of claim 2, wherein the at least one block further includes a first side block coupled to the first side rail and arranged to lie in spaced-apart relation to the first and second of the corner blocks and a second side block coupled to the second side rail and arranged to lie in spaced-apart relation to the third and fourth of the corner blocks.

5. The table top of claim 4, wherein the cellular core is formed to include a first side cutout located to receive the first side block therein, a first corner cutout located to receive the first of the corner blocks therein, a second corner cutout located to receive the second of the corner blocks therein, a second side cutout located to receive the second side block therein, a third corner cutout located to receive the third of the corner blocks therein, and a fourth corner cutout located to receive the fourth of the corner blocks therein.

6. The table top of claim 2, wherein each of the corner blocks is formed to include a bumper receiver facing toward the perimeter bumper, each of the side and end rails is formed to include a bumper receiver facing toward the perimeter bumper, and the perimeter bumper includes an outer rim extending around the side and end rails and lying outside of the interior region and a bumper retainer appended to the outer rim and arranged to extend into the bumper receivers formed in the side and end rails and in the corner blocks to retain the outer rim in a fixed position around the interior frame.

7. The table top of claim 6, wherein each side and end rail includes an upper strip coupled to the top sheet and a lower strip coupled to the bottom sheet and arranged to lie in spaced-apart relation to the upper strip to provide therebetween an elongated channel defining one of the bumper receivers formed in the side and end rails.

8. The table top of claim 6, wherein each corner block includes an upper strip coupled to the top sheet and a lower strip coupled to the bottom sheet and arranged to lie in spaced-apart relation to the upper strip to provide therebetween an elongated channel defining one of the bumper receivers formed in the corner blocks.

9. The table top of claim 2, wherein the first end rail includes a base coupled to the perimeter bumper and an end interlock portion appended to the base of the first end rail, the first side rail includes a base coupled to the perimeter bumper and a side interlock portion appended to the base of the first side rail, and the first of the corner blocks includes a rigidifying member arranged to lie adjacent to the cellular core, a first corner interlock portion coupled to the end interlock portion, and a second corner interlock portion coupled to the side interlock portion.

10. The table top of claim 9, wherein the first of the corner blocks includes a substantially L-shaped bumper mount having one end arranged to lie in confronting relation to a first end of the first end rail and in close proximity to the first corner interlock portion and having a second end arranged to lie in confronting relation to a first end of the first side rail and in close proximity to the second corner interlock portion, the L-shaped bumper mount is coupled to the rigidifying member and to the perimeter bumper and arranged to project outwardly from the rigidifying member to lie in a space located between the first ends of the first end rail and first side rail.

11. The table top of claim 9, wherein the end interlock portion includes upper and lower flanges arranged to lie in spaced-apart relation to one another to define a rail mount receiver therebetween and the first corner interlock portion includes a T-shaped rail mount appended to the rigidifying member and arranged to extend into the rail mount receiver defined between the upper and lower flanges of the end interlock portion.

12. The table top of claim 9, wherein the side interlock portion includes upper and lower flanges arranged to lie in spaced-apart relation to one another to define a rail mount receiver therebetween and the second corner interlock portion includes a T-shaped rail mount appended to the rigidifying member and arranged to extend into the rail mount receiver defined between the upper and lower flanges of the side interlock portion.

13. The table top of claim 1, wherein the first side block includes a rigidifying member arranged to lie adjacent to the cellular core and an interlock portion appended to the rigidifying member and coupled to the first side rail, the top sheet is arranged to overlie the cellular core and the rigidifying member, the top sheet is coupled to the first side rail to establish a fixed position of the top sheet relative to the interior frame, the bottom sheet is arranged to underlie the cellular core and the rigidifying member, and the bottom sheet is coupled to the first side rail to establish a fixed position of the bottom sheet relative to the interior frame.

14. The table top of claim 1, wherein the first side rail includes a base including an upper strip and a lower strip arranged to lie in spaced-apart relation to the upper strip to provide therebetween an elongated channel receiving a portion of the perimeter bumper therein to retain the perimeter bumper in a fixed position on the first side rail, the first side rail further includes upper and lower flanges coupled to the base and arranged to provide therebetween a rail mount receiver extending along a length of the first side rail, and the first side block includes a rigidifying member arranged to lie adjacent to the cellular core and a rail mount appended to the rigidifying member and arranged to extend into the rail mount receiver defined between the upper and lower flanges.

15. The table top of claim 1, wherein the first side rail includes a base coupled to the perimeter bumper and an interlock portion appended to the base, the first side block includes a rigidifying member arranged to lie adjacent to the cellular core and an interlock portion appended to the base, and the interlock portions of the first side rail and first side block are coupled to one another and cooperate to define interlock means for mounting the rigidifying member for sliding movement relative to the base so that the rigidifying member can be moved to assume a selected position on the base during assembly of the interior frame and preparatory to insertion of the cellular core in the interior region of the exterior shell.

16. The table top of claim 1, wherein the rail further includes first and second end rails arranged to lie in spaced-apart relation to one another to locate the cellular core therebetween, the at least one block further includes a second side block coupled to the second side rail, and each of the first and second side blocks is located in a position in the interior region of the exterior shell that is substantially midway between the first and second end rails.

17. The table top of claim 1, wherein the rail is circular and is arranged to surround the cellular core and the at least one block includes a first side block coupled to the circular rail.

18. The table top of claim 17, wherein the cellular core is formed to include a first side cutout located to receive the first side block therein.

19. The table top of claim 17, wherein the at least one block further includes second, third, and fourth side blocks coupled to the rail.

20. The table top of claim 19, wherein the first and third side blocks have a first size and the second and fourth side blocks have a second size larger than the first size.

21. The table top of claim 19, wherein the first, second, third, and fourth side blocks are arranged to lie in spaced-apart relation to one another about the circular rail to form corners of a reference rectangle inscribed in the circular rail and each side block includes means for receiving a fastener arranged to couple a table leg frame to the bottom sheet so that the table leg frame is anchored in a fixed position to the bottom sheet of the table top.

22. The table top of claim 17, wherein the circular rail includes a base coupled to the perimeter bumper and a curved interlock portion appended to the base, the first side block includes a rigidifying member arranged to lie adjacent to the cellular core and a curved interlock portion appended to the rigidifying member, and the curved interlock portions of the circular rail and first side block are coupled to one another and cooperate to define interlock means for mounting the rigidifying member for sliding movement along a curved path relative to the base so that the rigidifying member can be moved to assume a selected position on the base of the circular rail during assembly of the interior frame and preparatory to insertion of the cellular core in the interior region of the exterior shell.

23. The table top of claim 17, wherein the circular rail includes a curved upper strip and a curved lower strip arranged to lie in spaced-apart relation to the curved upper strip to provide therebetween an elongated curved channel receiving a portion of the perimeter bumper therein to retain the perimeter bumper in a fixed position on the circular rail.

24. The table top of claim 17, wherein the circular rail includes curved upper and lower flanges arranged to provide therebetween a curved rail mount receiver extending along a curved length of the circular rail and the first side block includes a rigidifying member arranged to lie adjacent to the cellular core and a curved rail mount appended to the rigidifying member and arranged to extend into the curved rail mount receiver defined between the curved upper and lower flanges.

25. The table top of claim 24, wherein the circular rail further includes a curved upper strip and a curved lower strip arranged to lie in spaced-apart relation to the curved upper strip to provide therebetween an elongated curved channel receiving a portion of the perimeter bumper therein to retain the perimeter bumper in a fixed position on the curved rail.

26. The table top of claim 17, wherein the interior frame further includes a first rigidifying beam having a first end coupled to the circular rail and an opposite second end coupled to the circular rail and the cellular core includes a first core portion lying on one side of the first rigidifying beam and a second core portion lying in spaced-apart relation to the first core portion on an opposite side of the first rigidifying beam.

27. The table top of claim 26, wherein the at least one side block further includes a second side block coupled to the circular rail and arranged to lie in spaced-apart relation to the first side block and the first core portion is formed to include a first side cutout located to receive the first side block therein and a second side cutout located to receive the second side block therein.

28. The table top of claim 26, wherein the interior frame further includes a second rigidifying beam lying in spaced-apart relation to the first rigidifying beam and having a first end coupled to the circular rail and an opposite second end coupled to the circular rail, the second core portion is arranged to lie on one side of the second rigidifying beam and between the first and second rigidifying beams, and the cellular core further includes a third core portion lying in spaced-apart relation to the second core portion on an opposite side of the second rigidifying beam.

29. The table top of claim 28, wherein the at least one side block further includes second, third, and fourth side blocks coupled to the circular rail and arranged to lie in spaced-apart relation to one another, the first core portion is formed to include a first side cutout located to receive the first side block therein and a second side cutout located to receive the second side block therein, and the third core portion is formed to include a third side cutout located to receive the third side block therein and a fourth side cutout located to receive the fourth side block therein.

30. The table top of claim 17, wherein the top and bottom sheets are coupled to the circular rail to retain the cellular core in the interior region.

31. The table top of claim 1, wherein each block includes means for receiving a fastener to couple a table leg frame to the bottom sheet so that the table leg frame is anchored in a fixed position to the bottom sheet of the table top.

32. A table top comprising an interior frame including in series first, second, third, and fourth corner blocks, each corner block including a rigidifying member, a first corner interlock portion, a second corner interlock portion, and a corner portion extending between the first and second corner interlock portions, the interior frame further including a first end rail slidably coupled at one end thereof to the first corner interlock portion of the first corner block and at another end thereof to the first interlock portion of the second corner block, a first side rail slidably coupled at one end thereof to the second corner interlock portion of the second corner block and at another end thereof to the second corner interlock portion of the third corner block, a second end rail slidably coupled at one end thereof to the first corner interlock portion of the third corner block and at another end thereof to the first corner interlock portion of the fourth corner block, and a second side rail slidably coupled at one end thereof to the second corner interlock portion of the fourth corner block and at another end thereof to the second corner interlock of the first corner block, a cellular core located in a space bounded by the side rails, end rails, and corner blocks, and an exterior shell formed to include an interior region containing the interior frame and the cellular core.

33. The table top of claim 32, wherein the cellular core is formed to include a first corner cutout located to receive the first corner block therein, a second corner cutout located to receive the second corner block therein, a third corner cutout located to receive the third corner block therein, and a fourth corner cutout located to receive the fourth corner block therein.

34. The table top of claim 32, further comprising a first side block coupled to the first side rail and arranged to lie in spaced-apart relation to the first and second corner blocks and a second side block coupled to the second side rail and arranged to lie in spaced-apart relation to the third and fourth corner blocks.

35. The table top of claim 34, wherein the cellular core is formed to include a first side cutout located to receive the first side block therein, a first corner cutout located to receive the first corner block therein, a second corner cutout located to receive the second of the corner blocks therein, a second side cutout located to receive the second side block therein, a third corner cutout located to receive the third corner block therein, and a fourth corner cutout located to receive the fourth of the corner blocks therein.

36. The table top of claim 32, wherein each of the side and end rails includes upper and lower flanges arranged to lie in spaced-apart relation to one another to define a rail mount receiver therebetween, each first corner interlock portion includes a T-shaped rail mount appended to the rigidifying member and arranged to slide into one of the rail mount receivers, and each second corner interlock portion includes a T-shaped rail mount appended to the rigidifying member and arranged to slide into another of the rail mount receivers.

* * * * *